US007788830B2

(12) United States Patent
Woerman et al.

(10) Patent No.: US 7,788,830 B2
(45) Date of Patent: Sep. 7, 2010

(54) EXCAVATION RETENTION ASSEMBLY

(75) Inventors: Gary Woerman, Mansfield, LA (US); Andrew S. Waszil, Canonsburg, PA (US)

(73) Assignee: CQMS Razer (USA) LLC, Maryborough QLD (AU)

( * ) Notice: Subject to any disclaimer, the term of this patent is extended or adjusted under 35 U.S.C. 154(b) by 0 days.

(21) Appl. No.: 12/068,602

(22) Filed: Feb. 8, 2008

(65) Prior Publication Data

US 2009/0199442 A1 Aug. 13, 2009

(51) Int. Cl.
*E02F 9/28* (2006.01)

(52) U.S. Cl. ..... 37/456; 37/453; 37/455; 403/379.3; 172/772

(58) Field of Classification Search ..... 37/449, 37/450, 452–457; 403/350, 374.3, 374.4, 403/372, 379.3; 172/753, 772
See application file for complete search history.

(56) References Cited

U.S. PATENT DOCUMENTS 1,088,916 A * 3/1914 McKee ..... 37/454
1,095,605 A * 5/1914 Tipping ..... 37/455
1,216,290 A * 2/1917 Dickson ..... 37/454
1,485,434 A * 3/1924 Seal ..... 37/455
1,690,834 A * 11/1928 Ratkowski ..... 37/455
1,722,154 A * 7/1929 Meyer ..... 37/456
1,787,695 A * 1/1931 McKee ..... 37/455
1,805,527 A * 5/1931 Cortright ..... 37/454
3,013,620 A * 12/1961 Hill ..... 172/762
3,191,323 A * 6/1965 Compagnoni ..... 37/455
3,997,989 A * 12/1976 Stepe ..... 37/457
4,067,657 A * 1/1978 Kaarlela ..... 403/317
4,096,653 A * 6/1978 Kaarlela et al. ..... 37/457
4,120,105 A * 10/1978 Stepe ..... 37/455
4,180,926 A * 1/1980 Klett et al. ..... 37/455
4,470,210 A * 9/1984 Hahn ..... 37/328
4,823,486 A * 4/1989 Diekevers et al. ..... 37/456
4,918,843 A * 4/1990 Kiesewetter et al. ..... 37/457
4,932,478 A * 6/1990 Jones ..... 172/699
5,009,017 A * 4/1991 Diekevers et al. ..... 37/456
5,077,918 A * 1/1992 Garman ..... 37/452
5,172,500 A * 12/1992 Renski et al. ..... 37/457
5,172,501 A * 12/1992 Pippins ..... 37/453
5,337,495 A * 8/1994 Pippins ..... 37/453
5,435,084 A * 7/1995 Immel ..... 37/398
5,833,323 A * 11/1998 Massa et al. ..... 299/102
5,918,391 A * 7/1999 Vinas Peya ..... 37/452
6,092,958 A * 7/2000 Gale ..... 403/378
6,430,851 B1 * 8/2002 Clendenning ..... 37/457
6,837,649 B2 * 1/2005 Livesay et al. ..... 404/124
6,848,203 B2 * 2/2005 Hohmann et al. ..... 37/446
6,959,506 B2 * 11/2005 Adamic et al. ..... 37/456

(Continued)

*Primary Examiner*—Thomas A Beach
(74) *Attorney, Agent, or Firm*—Breiner & Breiner, L.L.C.

(57) ABSTRACT

An excavation retention assembly is provided for mounting a tooth to an excavating apparatus. The assembly in one embodiment includes a tooth and an adaptor end of a working member of an excavating apparatus. The tooth includes a cavity for mating with an end of the adaptor, an opening for receiving a fastening member and a fastening receptacle in the cavity opposite the opening in the tooth for receiving the fastening member. The adaptor includes a passage which aligns with the opening in the tooth and the fastening member. The fastening member passes through the aligned opening of the tooth, the passage of the adaptor and into the fastening receptacle for securing the tooth to the adaptor.

22 Claims, 2 Drawing Sheets

U.S. PATENT DOCUMENTS

| | | | | |
|---|---|---|---|---|
| 7,036,249 | B2 * | 5/2006 | Mautino | 37/457 |
| 7,178,274 | B2 * | 2/2007 | Emrich | 37/453 |
| 7,313,877 | B2 * | 1/2008 | Clendenning et al. | 37/456 |
| 7,578,081 | B2 * | 8/2009 | Bearden et al. | 37/455 |
| 2002/0000053 | A1 * | 1/2002 | Adamic et al. | 37/456 |
| 2005/0066555 | A1 * | 3/2005 | Adamic | 37/455 |
| 2007/0107274 | A1 * | 5/2007 | Livesay et al. | 37/468 |
| 2008/0148608 | A1 * | 6/2008 | Harder et al. | 37/455 |

* cited by examiner 50
56
31
24
60
26
70
72
32
28
20
22
42
44
46
48
40

60
62
66
68

60
64
62

EXCAVATION RETENTION ASSEMBLY

FIELD OF THE INVENTION

The present invention relates to an improved assembly for affixing replaceable machine parts and, in particular, an assembly which permits the retention and removal of replaceable machine parts, such as teeth and shrouds on heavy mining and construction equipment working members, such as mining shovels, excavator buckets, backhoe buckets and other earth moving tools.

BACKGROUND OF THE INVENTION

Heavy construction equipment, such as backhoes and other earth moving devices often have excavator buckets, shovels or other tools with projecting teeth. Often, a cutting surface is applied or affixed to an exterior surface of the teeth. Typically, the teeth are attached to the excavator device or working member using bolts and/or pins, which are used to couple or retain the teeth to a respective adaptor or adaptor end of the working member. During use of such working members, peak loads applied to the teeth create high shearing stresses that may wear the teeth and/or assembly, requiring replacement. Traditionally, the removal and/or installation of the teeth to the adaptor require the use of a hammer, which is time consuming and, in some instances, a difficult process.

SUMMARY OF THE INVENTION

The present invention provides an assembly for quickly and easily attaching or retaining a tooth or similar structure to an adaptor or adaptor end of a cutting edge of construction and mining equipment, such as buckets, shovels or other tools. The assembly provides a retention assembly that allows for the removal or installation of the teeth or similar structure to the adaptor without the use of a hammer.

The present invention, in one form, relates to a retention assembly for mounting a tooth to an adaptor of an excavating apparatus. The retention assembly includes an adaptor, a tooth and a means for securing the tooth to the adaptor. The tooth includes an exterior cutting edge for providing the work function. The tooth includes an interior cavity for receiving an end of the adaptor. The interior walls of the tooth cavity are tapered and constructed and arranged to generally mate with the adaptor. The tooth further includes an opening for receiving a fastening means such as a bolt for fastening the tooth to the adaptor. The tooth further may include a recess in the interior cavity wall opposite the opening for receiving a fastening receptacle for engaging the fastening means inserted through the opening in the opposite wall of the tooth. The adaptor includes an end portion having tapered walls constructed and arranged to generally correspond to those of the tooth cavity and to mate with the cavity of the tooth. The tooth is slidably mounted onto the adaptor such that there is minimal play between the tooth and the adaptor. However, the tooth is not so tightly held as to wedge and lock tight on the adaptor, which would require removal by hammer or other means. The tapered walls of the adaptor preclude rotation of the tooth in any direction and any linear movement in all directions, except the forward direction. In the forward direction, the tooth is constrained by the fastening member.

The adaptor further includes an opening in the end portion constructed and arranged to align with the opening in the tooth and the fastening receptacle in the tooth. A fastening means is placed through the opening in the tooth, through the opening in the adaptor and engages an opening in the fastening receptacle. The fastening means is preferably a bolt comprising a first end having a means for inserting or removing the fastening means such as a ratchet end. The fastening means includes a second end having means for engaging the fastening receptacle such as threads. As stated above, the fastening means is inserted through the openings in the tooth and adaptor and engages the fastening receptacle for securing the fastening means in place to retain the tooth on the adaptor.

The fastening receptacle includes an opening for receiving the fastening means. It includes a top face which is generally flat and which engages a face of the adaptor. The fastening receptacle further includes a bottom face which is seated in the recess of the tooth. The fastening receptacle includes interior walls adjacent the opening for engaging a fastening member such as a threaded nut. A preferred fastening member is a hexagonal nut. When such hexagonal nut is used, the interior walls of the fastening receptacle are also hexagonal to hold the nut in place and keep it from rotating when engaging the fastening member. The fastening receptacle is placed in the recess of the interior wall of the tooth. There is sufficient clearance on the top and sides of the fastening receptacle and the recess of the tooth for receiving a durable polymer resin such as a polyurethane elastomer which may be poured around it and which then hardens to encapsulate the fastening receptacle in the wall of the tooth.

When it is desired to install a tooth to an adaptor, the tooth is slidably mated with the adaptor such that the tapered walls of the adaptor are adjacent to the corresponding tapered walls of the tooth. A fastening means such as a bolt is placed through the opening in the tooth and passes through the corresponding opening in the adaptor. The threaded end of the fastening means engages the fastening receptacle. The fastening means is then secured to the fastening receptacle. In a preferred embodiment, the fastening means is a bolt having a head with a ratchet means and a threaded end, and the fastening receptacle includes a threaded nut for receiving the bolt. When ratcheting the bolt into the nut, the upward force from the fastening means as it is tightened when passing through the nut in the fastening receptacle pushes up on the fastening receptacle and causes the polymer layer around and above the receptacle to distort upward against the face of the adaptor and into the hole of the adaptor to further aid in securing the tooth to the adaptor.

DETAILED DESCRIPTION

The present invention will now be described with regard to the several views of the drawings, where like numbers are identified using like numbers among the figures. It is to be understood that the excavation retention assembly of the invention may have a number of uses, including for excavating equipment, mining shovels, dragline buckets and the like.

The retention assembly of the invention may be used for attaching teeth onto adaptors, for attaching lip shrouds to bucket lips, for installing an adaptor onto a bucket or for similar purposes as known to those skilled in the art. For purposes of describing the invention, the invention will be illustrated with reference to the attachment of a tooth to an adaptor of a work member. However, the invention is not so limited and is to be considered broader in scope than the description of the illustrated embodiment.

Figures 1, 2:
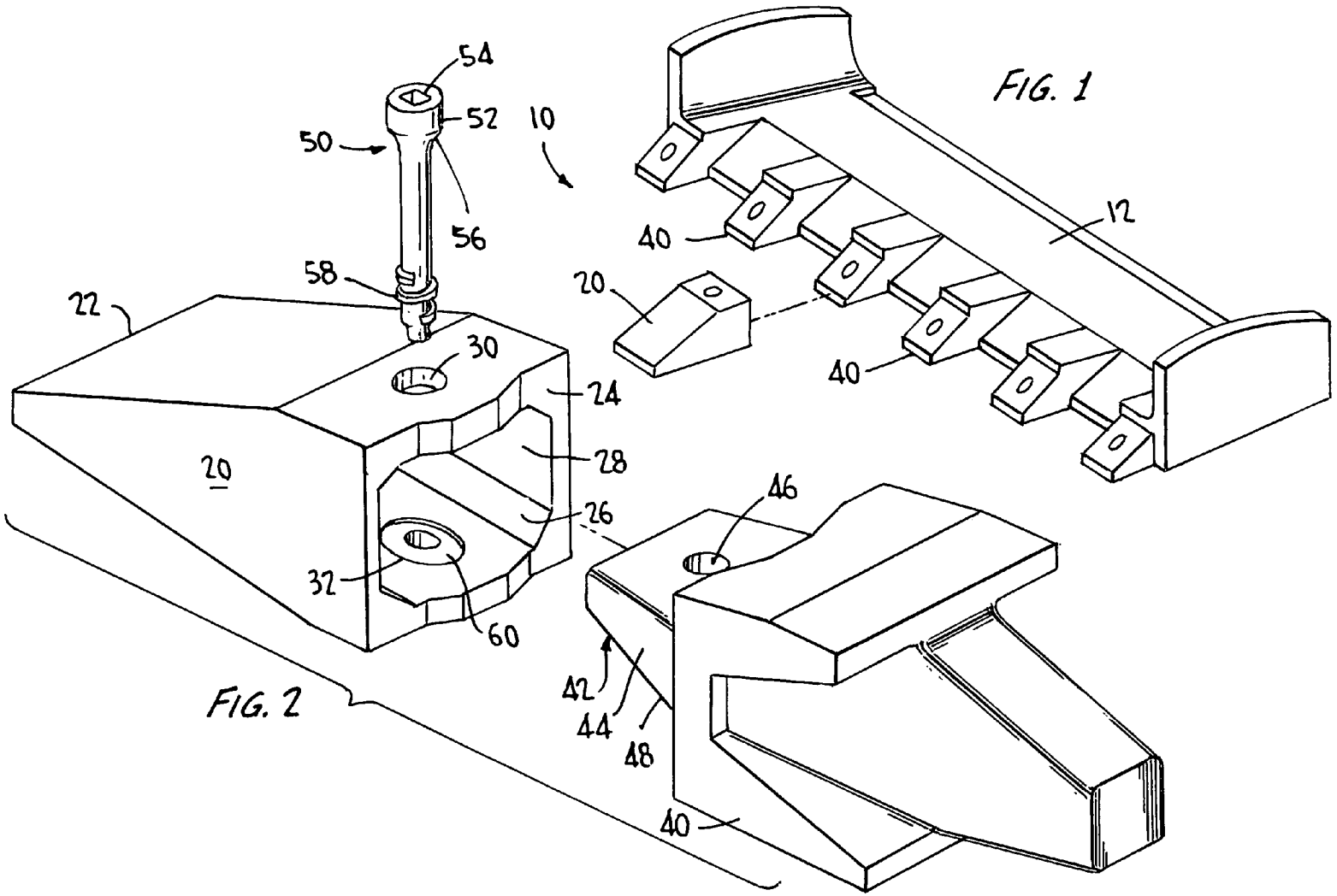
FIG. 1 is a perspective view of an excavating apparatus working member and the retention assembly in accordance with the present invention.
FIG. 2 is an exploded perspective view of the retention assembly of the invention shown in FIG. 1.

Referring now to FIGS. 1-5 and, in particular, FIG. 1, retention assembly 10 includes a working member 12 and allows for the removal, installation and retention of tooth 20 to an adaptor 40. For example, the working member 12 has a plurality of discrete adaptors 40 to which a respective tooth 20 can be retained. For simplification, only one tooth 20 is shown in FIG. 1.

Figure 3:
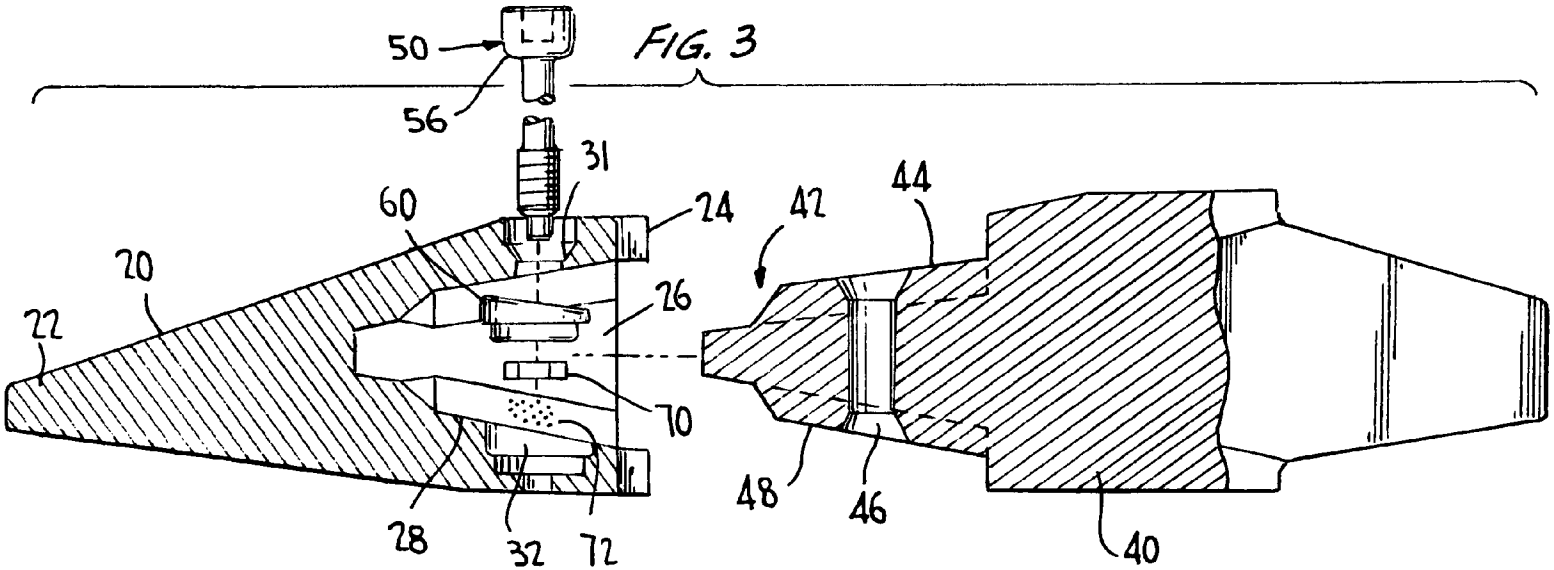
FIG. 3 is a partial cross-sectional exploded view of the retention assembly of FIG. 2 illustrating the tooth the adaptor and the fastening means.

Referring now to FIGS. 2 and 3 along with FIG. 1, tooth 20 includes an exterior cutting edge 22 to perform the work function of the tooth. Tooth 20 includes an end wall 24 which is constructed and arranged to abut the adaptor 40. Tooth 20 includes a cavity 26 with tapered walls 28 constructed and arranged to generally mate with corresponding tapered walls of adaptor 40. An opening 30 is in what will be referred to as the top wall of tooth 20, although it is understood that due to the symmetry of the tooth 20 and adaptor 40, tooth 20 may be reversibly installed on adaptor 40 such that the opening 30 may then be considered the bottom wall. Opposite the opening 30 in the bottom interior wall of the tooth 20 is a recess 32 constructed and arranged for receiving fastening receptacle 60.

The adaptor 40 may be separate and apart from the work member 12 or may be integral to work member 12. The adaptor 40 includes an end portion 42 for slidable insertion with cavity 26 of tooth 20. The end portion 42 includes tapered walls 44 which are constructed and arranged to mate with the corresponding tapered walls 28 of cavity 26. It is understood that a preferred embodiment of the general geometry of the tapered walls is shown in the FIGS. 2 and 3, although different geometries of taper may be used without departing from the scope of the invention. The geometry of the tapered walls 28 and 44 are such that the tooth 20 may be slidably mounted onto the adaptor 40 to hold the tooth in place with minimal play. However, the tooth is not held so tightly so as to wedge and lock tight in order to preclude the need for removal of the tooth from the adaptor with a hammer or similar implement. Additionally, the tapered faces of the walls 44 of the adaptor prevent the tooth from rotating on the adaptor in any direction and preclude linear movement of the tooth in all directions except the forward direction. In the forward direction, the tooth is constrained by the fastening member 50 as discussed in greater detail hereafter.

Additionally, adaptor 40 includes an opening 46 through end portion 42. The opening is constructed and arranged to align with the opening 30 in tooth 20 and an opening 62 in fastening receptacle 60 to allow passage of fastening means 50 through openings 30, 46 and 62.

Figure 5:
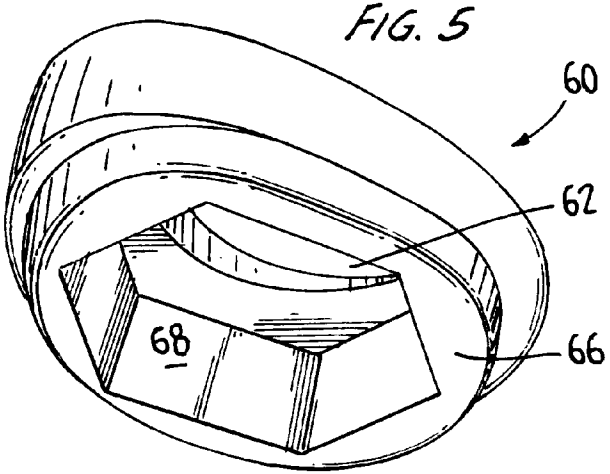
FIG. 5 is a perspective bottom view of the fastening receptacle of FIG. 4.
Figure 4:
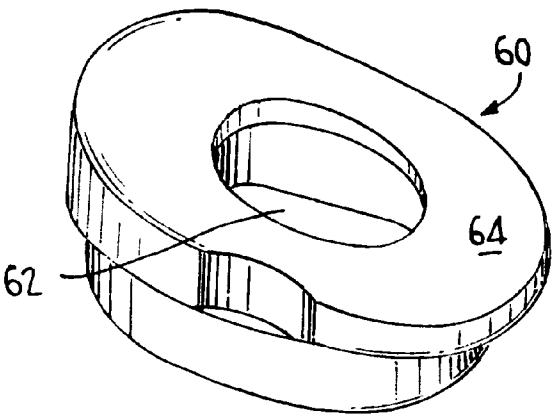
FIG. 4 is a perspective top view of the fastening receptacle which is inserted into an interior wall of the tooth.

Fastening receptacle 60 includes a top face 64 which is generally flat and engages the bottom wall 48 of the end portion 42. There is an opening 62 in this top wall 64 through which fastening member 50 is allowed to pass to engage a fastening member 70. Fastening receptacle 60 includes a bottom face 66 which is seated in recess 32 of tooth 20. Receptacle 60 includes an interior wall 68 constructed and arranged to receive the fastening member 70 which in the preferred embodiment is a threaded hexagonal nut. When the fastening member 70 is hexagonal, the interior wall 68 is also hexagonal as shown in FIG. 5 for receiving and fastening nut 70. This also prevents rotation of nut 70.

Fastening receptacle 60 may be held in place in recess 32 by a durable polymer resin 72 such as a polyurethane elastomer. In the preferred embodiment, the fastening receptacle is placed into recess 32 in the bottom interior wall of tooth 20 with sufficient clearance on the top and sides so that the polyurethane elastomer can be poured around it and then it hardens so as to encapsulate and hold in place the fastening receptacle 60. It should be understood that other means may be used to retain fastening receptacle 60 in recess 32 without departing from the scope of the invention.

A fastening means 50 is used to secure tooth 20 to adaptor 40. In the preferred embodiment, the fastening means 50 comprises a bolt having an upper end 52 having a ratchet opening 54 for engagement with a ratchet wrench to install the tooth on the adaptor or to remove the tooth from the adaptor. Fastening means 50 includes a shoulder wall 56 which is seated on corresponding shoulder portion 31 of opening 30 as best shown in FIG. 3. This shoulder portion of the bolt will receive a portion of the shock contact when the working member is in use and reduces the stress to the bolt. Fastening means 50 further includes a male threaded portion 58 which engages female threaded portion (not shown) of fastening nut 70.

In use, the tooth 20 can be secured to the adaptor 40 by slidably inserting the tooth cavity 26 onto adaptor end 42. As previously mentioned, the interior walls 28 of cavity 26 are constructed and arranged to generally mate with the tapered walls 44 of adaptor 40 while at the same time not being so tight as to not be removable without a hammer or other implement. When tooth 20 is so engaged with adaptor 40, the openings 30 in tooth 20, 46 in adaptor 40, and 62 in receptacle 60 are in alignment. Fastening bolt 50 is inserted through these openings and a ratchet wrench is used to tighten bolt 50 into fastening nut 70. The upward force from the bolt 50 as it is tightened when passing through nut 70 pushes up on receptacle 60 and causes the polymer resin around the receptacle 60 to distort upward against the lower face of adaptor 40 and around and into hole 46 to further secure the tooth to the adaptor.

Although the invention has been described above in relation to preferred embodiments thereof, it will be understood by those skilled in the art that variations and modifications can be effected in these preferred embodiments without departing from the scope and spirit of the invention. For example, while the fastening means and fastening member of a preferred embodiment are engaged by thread means and a ratchet, other securing means may be used without departing from the scope of the invention. Additionally, while a preferred embodiment includes a recess in the tooth for engaging the fastening receptacle, the fastening receptacle may be secured in the tooth by other means without the need for the recess.

It is claimed:

1. A tooth assembly for mounting a tooth to an excavating apparatus, the assembly comprising:

an adaptor end having an adaptor slot passing through the adaptor end;

a tooth having a tooth bore terminating in an inner cavity and a fastening receptacle in said inner cavity substantially opposite said tooth bore and located in a recess of the tooth, the tooth affixed to the adaptor end with the tooth bore, the adaptor slot and the fastening receptacle all in alignment; and a fastening member for retention of said tooth to said adaptor end passing through said tooth bore, said adaptor slot and said fastening receptacle and threadably engaging a fastening means at least partially received within said fastening receptacle.

2. The tooth assembly of claim 1, wherein the adaptor end is unitarily formed with a working member of the excavating apparatus.

3. The tooth assembly of claim 1, wherein the adaptor end is a separate element affixed to a working member of the excavating apparatus.

4. The tooth assembly of claim 1, wherein the fastening member comprises a bolt having threads on one end and a means for engaging a torquing tool on an opposite end.

5. The tooth assembly of claim 4, wherein said fastening means includes female threads for engaging said bolt.

6. The tooth assembly of claim 5, wherein the fastening means comprises a nut.

7. The tooth assembly of claim 6, wherein the nut is hexagonal.

8. The tooth assembly of claim 1, wherein the fastening receptacle is retained in the tooth by a polymer resin.

9. The tooth assembly of claim 8, wherein the polymer resin is a polyurethane resin.

10. The tooth assembly of claim 1, wherein said adaptor end and said tooth cavity include tapered walls which are constructed and arranged to substantially mate with one another.

11. The tooth assembly of claim 1, wherein when said fastening member is tightened said fastening receptacle engages said adaptor end.

12. The tooth assembly of claim 1, wherein the inner cavity is substantially four sided.

13. An excavation retention assembly for mounting a first member to a second member of an excavating apparatus, the assembly comprising:

a first member and a second member, said first member having a cavity constructed and arranged for mating with said second member and having an opening in a wall of said cavity and to be aligned with a slot of said second member and having a fastening receptacle opposite said opening and located in a recess of said first member;

said second member having an end portion and having said slot passing through the second member, said slot is aligned with the opening of said first member and said end portion is constructed and arranged to mate with the cavity of said first member, and a fastening member for retaining said first member to said second member wherein said fastening member passes through said opening of said first member, said slot of said second member and said fastening receptacle and threadably engages a fastening means at least partially received within said fastening receptacle.

14. The excavation retention assembly of claim 13, wherein the fastening receptacle is retained in said first member by a polymer resin.

15. The excavation retention assembly of claim 14, wherein the polymer resin is a polyurethane resin.

16. The excavation retention assembly of claim 13, wherein the fastening member comprises a bolt having threads on one end and a means for engaging a torquing tool on an opposite end.

17. The excavation retention assembly of claim 16, wherein the fastening receptacle is retained in said first member by a polymer resin.

18. The excavation retention assembly of claim 17, wherein the polymer resin is a polyurethane resin.

19. The excavation retention assembly of claim 16, wherein the fastening means includes female threads for engaging said bolt.

20. The excavation retention assembly of claim 19, wherein the fastening means comprises a nut.

21. The excavation retention assembly of claim 20, wherein the nut is hexagonal.

22. The excavation retention assembly of claim 13, wherein the cavity of said first member and the end portion of said second member include tapered walls constructed and arranged to mate with one another.

* * * * *